US011097563B2

(12) United States Patent
Aono

(10) Patent No.: US 11,097,563 B2
(45) Date of Patent: Aug. 24, 2021

(54) IMAGE FORMING SYSTEM AND RELAY CONVEYANCE APPARATUS

(71) Applicant: KYOCERA Document Solutions Inc., Osaka (JP)

(72) Inventor: Shinya Aono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/942,887

(22) Filed: Jul. 30, 2020

(65) Prior Publication Data

US 2021/0039411 A1 Feb. 11, 2021

(30) Foreign Application Priority Data

Aug. 5, 2019 (JP) ..... JP2019-143930

(51) Int. Cl.
*B41J 29/377* (2006.01)
*B41J 11/00* (2006.01)

(52) U.S. Cl.
CPC ..... *B41J 29/377* (2013.01); *B41J 11/006* (2013.01); *B41J 11/007* (2013.01); *B65H 2301/5144* (2013.01); *B65H 2301/5305* (2013.01)

(58) Field of Classification Search
CPC ..... B41J 29/377; B41J 11/006; B41J 11/007; B65H 2301/5305; B65H 2301/5144; B65H 37/00
See application file for complete search history.

(56) References Cited

U.S. PATENT DOCUMENTS

2005/0122372 A1* 6/2005 Shimizu ..... B41J 2/16585 347/22
2009/0195629 A1* 8/2009 Yamada ..... G11B 23/40 347/104
2016/0320749 A1* 11/2016 Komatsuzaki ..... G03G 15/6552
2017/0072708 A1* 3/2017 Miyashita ..... B41J 11/002

FOREIGN PATENT DOCUMENTS

JP 2019052031 A 4/2019

* cited by examiner

*Primary Examiner* — Henok D Legesse
(74) *Attorney, Agent, or Firm* — Studebaker & Brackett PC

(57) ABSTRACT

The relay conveyance apparatus includes a casing, an opening, a cover, a conveyance guide, a protruding part and a cooling mechanism. The casing has an inner space in which a relay conveyance path is formed. The opening is formed in the casing. The protruding part is provided in the cover. When the conveyance guide is switched to a path formation position, the protruding part is inserted into the inner space of the casing to allow closing of the cover, and when the conveyance guide is switched to a path opening position, the protruding part interferes with the conveyance guide to restrict the closing of the cover. The cooling mechanism includes a main duct, a fan and an air blowing port. The air blowing port is provided in the protruding part, and through which the cooling air is blown from the main duct to the relay conveyance path.

8 Claims, 9 Drawing Sheets

IMAGE FORMING SYSTEM AND RELAY CONVEYANCE APPARATUS

INCORPORATION BY REFERENCE

This application is based on and claims the benefit of priority from Japanese Patent application No. 2019-143930 filed on Aug. 5, 2019, which is incorporated by reference in its entirety.

TECHNICAL FIELD

The present disclosure relates to a relay conveyance apparatus conveying a sheet on which an image is formed in an image forming apparatus to a post-processing apparatus, and an image forming system containing the relay conveyance apparatus.

BACKGROUND

In the relay conveyance apparatus, when a sheet jamming occurs on a relay conveyance path or when an operation is urgently stopped at detecting of an abnormality, because a sheet conveyance operation is stopped, a sheet remains on the relay conveyance path. In order to remove the remaining sheet, a conveyance guide is disposed at predetermined positions on the relay conveyance path. The conveyance guide is configured to be tuned between a relay conveyance path forming position and a relay conveyance path opening position. When the conveyance guide is turned to the relay conveyance path opening position, it becomes possible to remove the remaining sheet.

On the other hand, if the relay conveyance apparatus starts the sheet conveyance operation while the conveyance guide is turned to the relay conveyance path opening position, a sheet conveyance failure occurs. Then, a restriction member to restrict the sheet conveyance operation while the conveyance guide is turned to the relay conveyance path opening position is sometimes provided.

By the way, when the sheet on which an image is formed in an inkjet type image forming manner is conveyed, it is necessary to promote correction of curl of the sheet or drying of the ink. Then, in many cases, the relay conveyance apparatus is provided with a curl correction unit or a warm air sending unit. Alternatively, a heater to heat the relay conveyance path is sometimes provided.

However, if the relay conveyance path is heated as described above, an operator may feel discomfort by touching the heated air when he removes the sheet remaining on the relay conveyance path.

SUMMARY OF THE DISCLOSURE

In accordance with one aspect of the present disclosure, a relay conveyance apparatus is disposed between an image forming apparatus forming an image on a sheet and a post-processing apparatus performing a post-processing on the sheet. The relay conveyance apparatus includes a casing, a relay conveyance path, an opening, a cover, a conveyance guide, a protruding part and a cooling mechanism. The casing has an inner space. The relay conveyance path is formed in the inner space, along which the sheet is conveyed from the image forming apparatus to the post-processing apparatus is formed. The opening is formed in a side plate of the casing, and through the opening, the inner space of the casing is exposed. The cover opens and closes the opening. The conveyance guide is switchable between a path formation position where the relay conveyance path is formed and a path opening position where the relay conveyance path is opened. The protruding part is provided in the cover. When the conveyance guide is switched to the path formation position, the protruding part is inserted into the inner space of the casing to allow closing of the cover, and when the conveyance guide is switched to the path opening position, the protruding part interferes with the conveyance guide to inhibit from being inserted into the inner space of the casing and to restrict the closing of the cover. The cooling mechanism cools the relay conveyance path. The cooling mechanism includes a main duct, a fan and an air blowing port. The main duct is provided in the cover, and through the man duct, cooling air is passed. The fan feeds the cooling air to the main duct. The air blowing port is provided in the protruding part, and through which the cooling air is blown from the main duct to the relay conveyance path.

In accordance with one aspect of the present disclosure, an image forming system includes an image forming apparatus forming an image on a sheet, a post-processing apparatus performing a post-processing on the sheet and the relay conveyance apparatus disposed between the image forming apparatus and the post-processing apparatus.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming system and a relay conveyance apparatus according to one embodiment of the present disclosure will be described.

Figure 1:
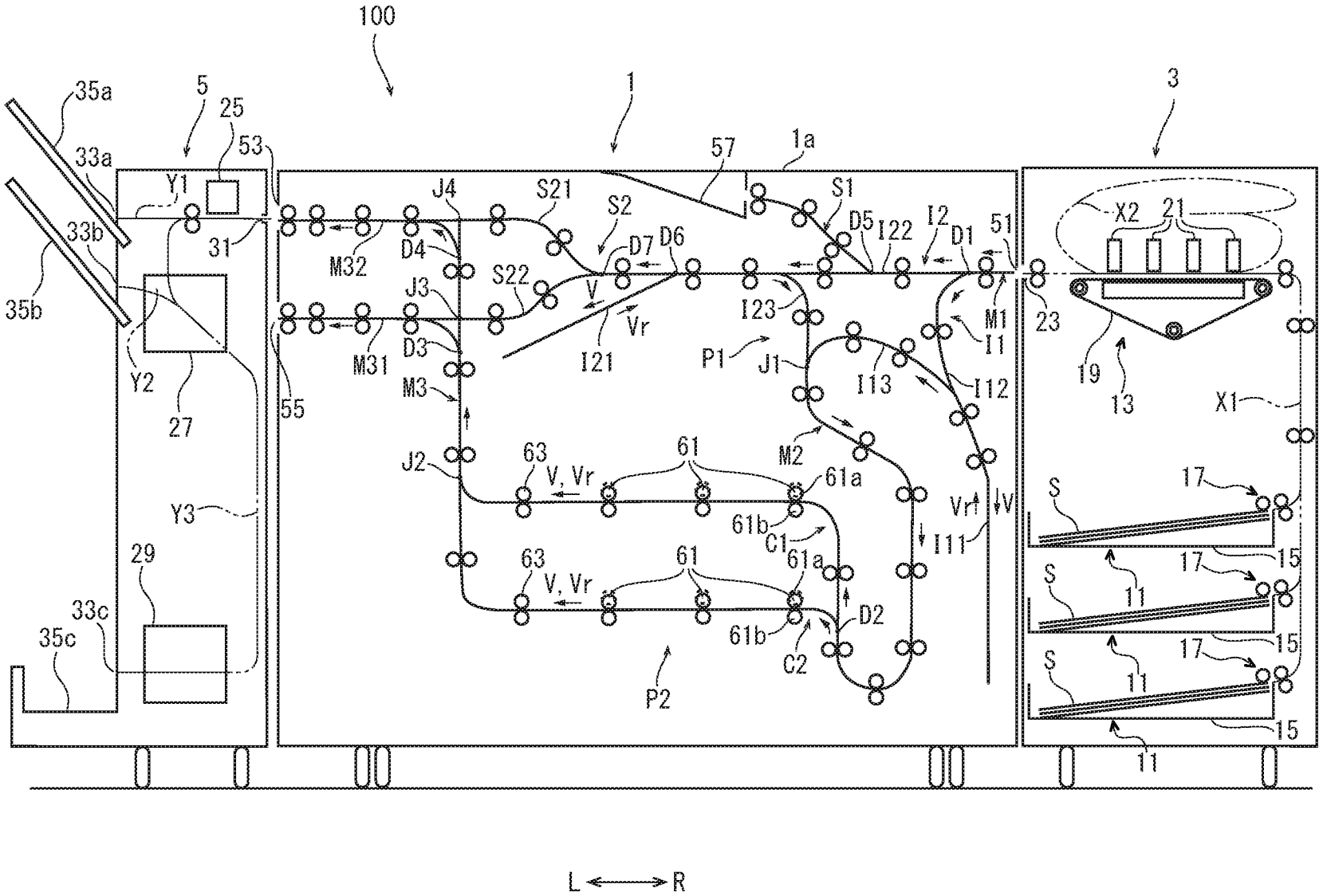
FIG. 1 is a front view schematically showing an inner structure of an image forming system according to one embodiment of the present disclosure.

With reference to FIG. 1, the image forming system 100 will be described. FIG. 1 is a front view schematically showing an inner structure of the image forming system. A front side of the paper on which FIG. 1 is drawn is defined as a front side of the image forming system. "Fr", "Rr", "L" and "R" marked in each figure respectively show a front side, a rear side, a left side and a right side of the image forming system.

The image forming system 100 includes an image forming apparatus 3 which forms an image on a sheet, a post-processing apparatus 5 which performs a post-processing on the sheet on which the image is formed in the image forming apparatus 3, and a relay conveyance apparatus 1 which is disposed between the image forming apparatus 3 and the post-processing apparatus 5 and conveys the sheet from the image forming apparatus 3 to the post-processing apparatus 5.

Firstly, the image forming apparatus 3 and the post-processing apparatus 5 will be described.

The image forming apparatus 3 includes a plurality of sheet feeding parts 11 and an inkjet type image forming part 13. The sheet feeding parts 11 are disposed side by side in the upper-and-lower direction, and each includes a sheet feeding cassette 15 storing a sheet and a sheet feeding unit 17 feeding the sheet from the sheet feeding cassette 15. The image forming part 13 includes a conveyance belt 19 which is driven to be circulated and four recording heads 21 which are disposed side by side along the traveling direction of the conveyance belt 19. The image forming apparatus 3 has a discharge port 23 for the sheet on the upper portion of the side surface (the left side surface) on a side of the relay conveyance apparatus 1.

Additionally, in the image forming apparatus 3, a conveyance path X1 and an inversion path X2 are formed. The conveyance path X1 is formed such that the sheet is conveyed from the sheet feeding unit 17 of each sheet feeding part 11 to the discharge port 23 through the image forming part 13. The inversion path X2 is formed so as to invert the front and back of the sheet. The inversion path X2 is branched from the conveyance path X1 on a downstream side of the image forming part 13 in the sheet conveyance direction and joined to the conveyance path X1 on an upstream side of the image forming part 13.

Next, an image forming operation of the image forming apparatus 3 will be described. Firstly, in each sheet feeding part 11, the sheet feeding unit 17 feeds the sheet from the sheet feeding cassette 15 to the conveyance path X1. The fed sheet is conveyed along the conveyance path X1, and sucked on the upper face of the conveyance belt 19 in the image forming part 13. Then, an image is formed on the sheet by the ink ejected from the recording heads 21 while the sheet being conveyed with the circulating of the conveyance belt 19. The sheet on which the image is formed is conveyed by the conveyance belt 19 and then discharged through the discharge port 23. When a duplex printing is performed, the sheet on which an image is formed on one side surface is conveyed to the inversion path X2, and the front and back of the sheet is inverted. Thereafter, the sheet is conveyed along the conveyance path X1 and sucked on the upper face of the conveyance belt 19. Then, an image is formed on the other side surface of the sheet while the sheet being conveyed with the circulating of the conveyance belt 19. The sheet is discharged through the discharge port 23 with a posture the last printed side surface facing upward.

Next, the post-processing apparatus 5 will be described. The post-processing apparatus 5 is a finisher which performs a punching processing, a staple processing and a folding processing on the sheet selectively, and includes a punching unit 25, a stapler 27 and a folding unit 29. The post-processing apparatus 5 has a carrying-in port 31 on the upper portion of the side face (the right side face) on a side of the relay conveyance apparatus 1. Through the carrying-in port 31, the sheet is received from the relay conveyance apparatus 1. The post-processing apparatus 5 has three discharge ports 33*a*, 33*b* and 33*c* on the side surface (the left surface) on opposite side to the relay conveyance apparatus 1. The three discharge ports 33*a*, 33*b* and 33*c* are disposed so as to correspond to the punching unit 25, the stapler 27 and the folding unit 29. Furthermore, below the three discharge ports 33*a*, 33*b* and 33*c*, discharge trays 35*a*, 35*b* and 35*c* are provided respectively.

Additionally, in the post-processing apparatus 5, a first conveyance path Y1, a second conveyance path Y2 and a third conveyance path Y3 are formed. The first conveyance path Y1 is formed such that the sheet is conveyed from the carrying-in port 31 to the upper discharge port 33*a* through the punching unit 25. The second conveyance path Y2 is formed so as to be branched from the first conveyance path Y1 on a downstream side of the punching unit 25 in the sheet conveyance direction and to extend to the center discharge port 33*b* through the stapler 27. The third conveyance path Y3 is formed so as to be branched from the second conveyance path Y2 and to extend to the lower discharge port 33*c* through the folding unit 29.

Next, the post-processing operation of the post-processing apparatus 5 will be described. The sheet on which the image is formed in the image forming apparatus 3 is conveyed through the relay conveyance apparatus 1 (described detail later), and carried in the first conveyance path Y1 through the carrying-in port 31. When performing the punching processing, the sheet is conveyed along the first conveyance path Y1 to the punching unit 25, punched by the punching unit 25, conveyed along the first conveyed path Y1, discharged through the upper discharge port 33*a* and then stacked on the upper discharge tray 35*a*. When performing the stapling processing, the sheet is conveyed along the first conveyance path Y1 and then the second conveyance path Y2 to the stapler 27, stapled by the stapler 27, discharged through the center discharge port 33*b* and then stacked on the center discharge tray 35*b*. When performing the folding processing, the sheet is conveyed along the first conveyance path Y1, the second conveyance path Y2 and then third conveyance path Y3 to the folding unit 29, folded by the folding unit 29, discharged through the lower discharge port 33*c* and then stacked on the lower discharge tray 35*c*.

Figure 2:
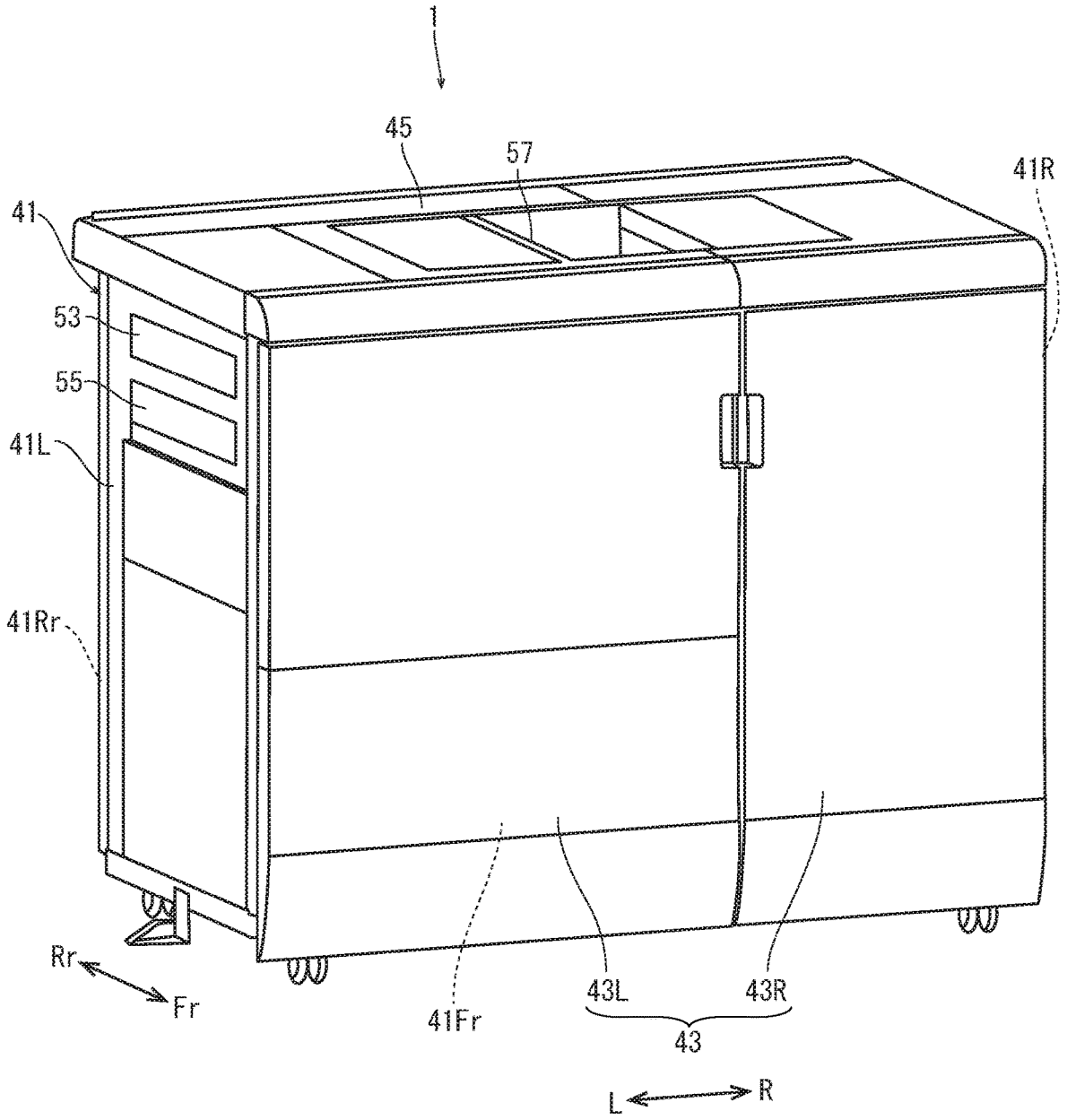
FIG. 2 is a perspective view showing a relay conveyance apparatus according to the embodiment of the present disclosure.
Figure 3:
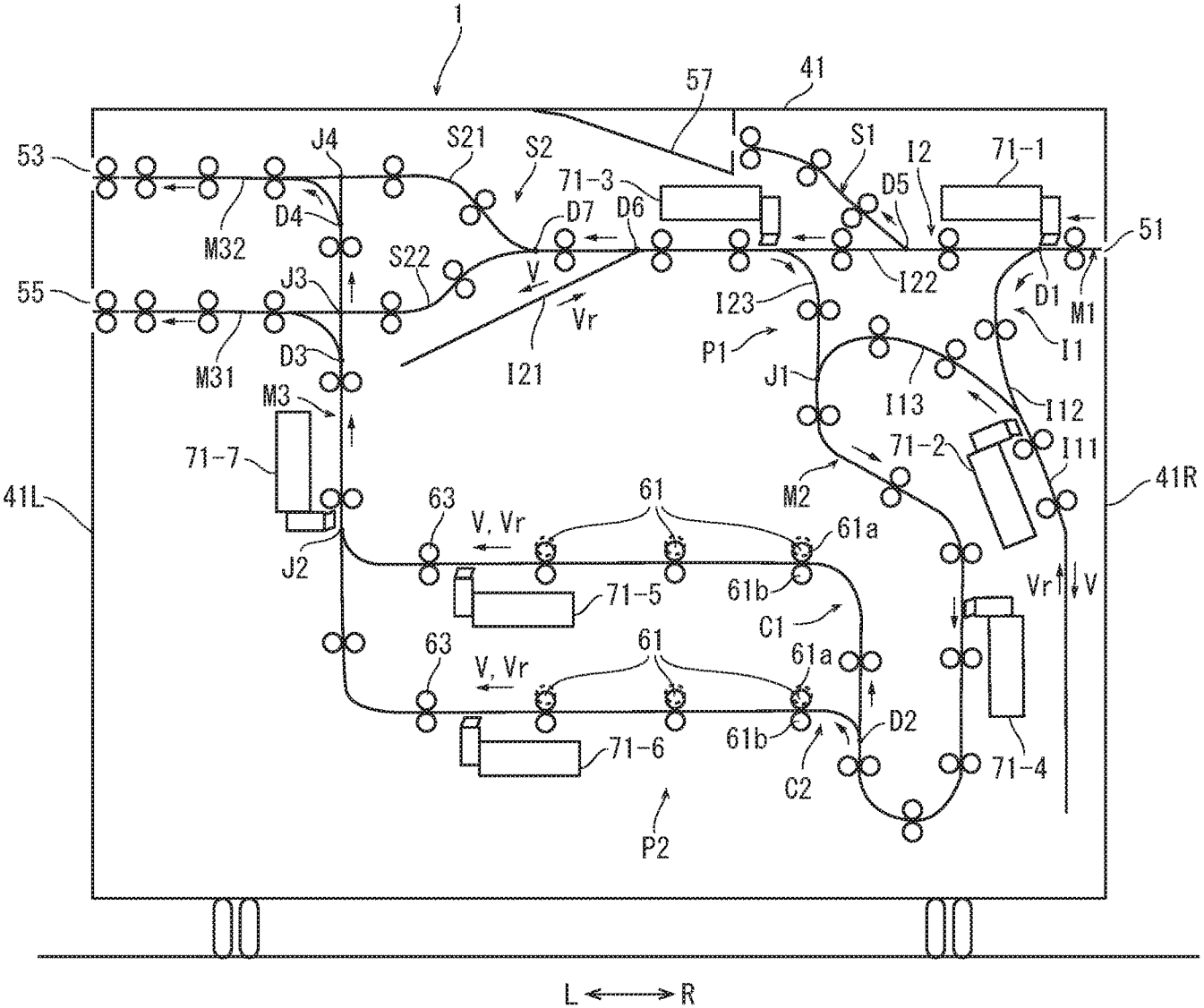
FIG. 3 is a front view schematically showing an inner structure of the relay conveyance apparatus according to the embodiment of the present disclosure.

Next, the relay conveyance apparatus 1 will be described with reference to FIG. 2 and FIG. 3, in addition to FIG. 1. FIG. 2 is a perspective view showing the relay conveyance apparatus 1, and FIG. 3 is a front view schematically showing the inner structure of the relay conveyance apparatus 1. The relay conveyance apparatus 1 is provided separately from the image forming apparatus 2 and the post-processing apparatus 3, and coupled with the image forming apparatus 3 and the post-processing apparatus 5.

The relay conveyance apparatus 1 includes a casing 41 having a parallelepiped inner space as shown in FIG. 2. The casing 41 has a front side plate 41Fr, a rear side plate 41Rr, a left side plate 41L and a right side plate 41R surrounding the four sides (the front side, the rear side, the left side and the right side) of the inner space. The side plates may be formed integrally or separately. The front surface of the front side plate 41Fr is covered with a front cover 43, and the upper surface of the casing 41 is covered with an upper cover 45. The front cover 43 is divided into a left cover 43L and a right cover 43R. The front cover 43 will be described later.

As shown in FIG. 1 and FIG. 3, the right side plate 41R (the side plate on a side of the image forming apparatus 3) has a carrying-in port 51 through which the sheet is carried in from the image forming apparatus 3. The carrying-in port 51 is disposed on the same height as the discharge port 23 of the image forming apparatus 3. As shown in FIG. 1 to FIG. 3, the left side plate 41L (the side plate on a side of the post-processing apparatus 5) has an upper deliver port 53 and a lower deliver port 55. The upper deliver port 53 is disposed on the same height as the carrying-in port 31 of the post-processing apparatus 5 (the finisher), and the lower deliver port 55 is disposed on the same height as a carrying-in port of a stacker (not shown). The upper cover 45 has a discharge tray 57.

In the inner space of the casing 41, a relay conveyance path is formed, along which the sheet is conveyed from the carrying-in port 51 to the upper and lower deliver ports 53 and 55. The relay conveyance path has an carrying-in path M1, a first synchronizing path P1, a middle path M2, a second synchronizing path P2 and a discharge path M3 in the order from the carrying-in port 51 to the deliver ports 53 and 55.

The first synchronizing path P1 has a first inversion path I1 and a second inversion path I2 which are branched from the carrying-in path M1 at a first branch point D1 and joined to the middle path M2 at a first join point J1. The second synchronizing path P2 has a first correction path C1 and a second correction path C2 which are branched from the middle path M2 at a second branch point D2 and joined to the discharge path M3 at a second join point J2. Along the carrying-in path M1, the middle path M2 and the discharge path M3, all the sheets are conveyed. Along the first inversion path I1 and the second inversion path I2 of the first synchronizing path P1 and along the first correction path C1 and the second correction path P2 of the second synchronizing path P2, the sheet is alternatively conveyed. In the following description, the upstream side and the downstream side respectively show the upstream side and the downstream side in the above sheet conveyance direction.

The carrying-in path M1 extends horizontally leftward from the carrying-in port 51, and branches into the first inversion path I1 and the second inversion path I2 at the first branch point D1.

The first inversion path I1 has a switch-back path I11 on which the front and back of the sheet is inversed, a going path I12 along which the sheet is conveyed to the switch-back path I11, and a returning path I13 along which the switch-backed sheet is conveyed. The going path I12 extends downward from the first branch point D1. The switch-back path I11 extends downward from the outlet of the going path I12. The returning path I13 extends leftward from the inlet/outlet of the switch-back path I11. The sheet is conveyed along the going path I12 and then the switch-back path I11 in the conveyance direction V, stopped temporarily and then conveyed from the switch-back path I11 to the returning path I13 in a re-conveyance direction Vr opposite to the conveyance direction V.

The second inversion path I2 has a switch-back path I21 on which the front and back of the sheet is inversed, a going path I22 along which the sheet is conveyed to the switch-back path I21, and a returning path I23 along which the switch-backed sheet is conveyed. The going path I22 extends approximately horizontally leftward from the first branch point D1. The switch-back path I21 extends horizontally leftward from the outlet of the going path I22 and then is inclined in a left lower direction. The returning path I23 extends downward from the inlet/outlet of the switch-back path I21. The sheet is conveyed along the going path I22 and then the switch-back path I21 in the conveyance direction V, stopped temporarily and then conveyed from the switch-back path I21 to the returning path I23 in a re-conveyance direction Vr opposite to the conveyance direction V.

The returning path I13 of the first inversion path I1 and the returning path I23 of the second inversion path I2 are joined to the middle path M2 at the first join point J1. The middle path M2 extends downward from the first join point J1 and then is curved in a left upper direction. The middle path M2 is branched into the first correction path C1 and the second correction path C2 at the second branch point D2.

The first correction path C1 and the second correction path C2 each extending approximately horizontally are disposed side by side in the upper-and-lower direction. Along each of the first correction path C1 and the second correction path C2, three pairs of switching rollers 61 and a pair of correction rollers 63 are provided in the order from the upstream side. The three pairs of switching rollers 61 and the pair of correction rollers 63 are disposed along the conveyance direction at predetermined intervals. The pair of switching rollers 61 includes an upper roller 61*a* and a lower roller 61*b*, and the upper roller 61*a* is movable in the upper-and-lower direction between a nip position (refer to the solid line in FIG. 1 and FIG. 3) where the upper roller 61*a* comes into contact with the lower roller 61*b* and a nip release position (refer to the dotted line in FIG. 1 and FIG. 3) where the upper roller 61*a* is separated from the lower roller 61*b* upward. As described later in detail, while the upper roller 61*a* is moved to the nip position, the conveyance of the sheet in the conveyance direction V is stopped, and after the upper roller 61*a* is moved to the nip release position, the sheet is re-conveyed in the re-conveyance direction Vr which is the same direction as the conveyance direction V. The pair of correction rollers 63 is movable in a width direction (the front-and-rear direction) perpendicular to the conveyance direction.

The first correction path C1 and the second correction path C2 are joined to the discharge path M3 at the second join point J2. The discharge path M3 extends upward from the second join point J2. On the discharge path M3, a third branch point D3, a third join point J3, a fourth branch point D4 and a fourth join point J4 are provided. The discharge path M3 is branched at the third branch point D3 into a lower discharge path M31 which is curved in a left upper direction and then extends horizontally to the lower deliver port 55. The discharge path M3 is branched at the fourth branch point D4 into an upper discharge path M32 which is curved in a left upper direction and then extends horizontally to the upper deliver port 53.

Furthermore, the relay conveyance path has a first sub path S1 and a second sub path S2. On the first sub path S1, the sheet which does not require the inversion, the correction and the post-processing is conveyed. On the second sub path S2, the sheet which does not require the inversion and the correction and requires the post-processing is conveyed.

The first sub path S1 is branched at a fifth branch point D5 on a middle of the returning path I22 of the second inversion path I2, and extends to the discharge tray 57. The second sub path S2 is branched leftward at a sixth branch point D6 on a middle of the switch-back path I21 of the second inversion path I2, and then branched at a seventh branchpoint D7 into an upper sub path S21 and a lower sub path S22. The upper sub path S21 is joined to the upper discharge path M32 at the fourth join point J4 on the discharge path M3. The lower sub path S22 is joined to the lower discharge path M31 at the third join point J3 on the discharge path M3.

On the carrying-in path M1, the switch-back path I11 of the first inversion path I1, the switch-back path I21 of the second inversion path I2, the middle path M2, the first correction path C1, the second correction path C2 and the discharge path M3, first to seventh warm air sending units 71-1 to 71-7 (hereinafter, called the warm air sending unit 71 simply) are provided.

Figure 4:
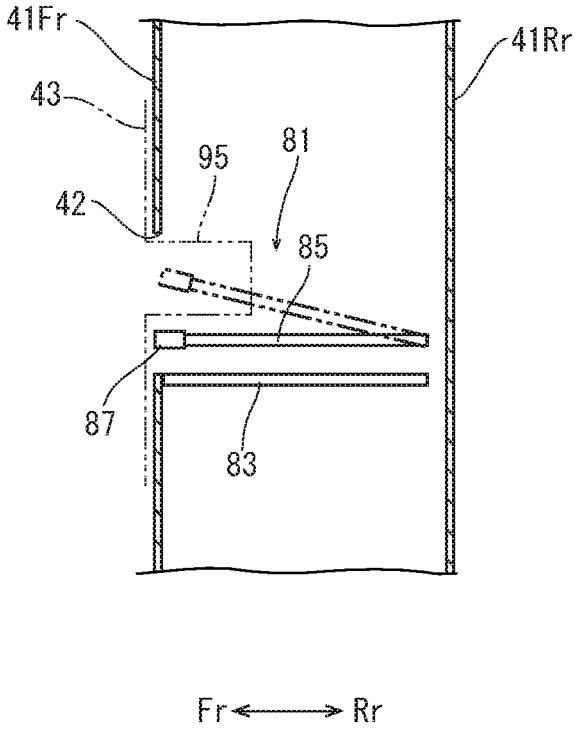
FIG. 4 is a side view schematically showing a conveyance guide in the relay conveyance apparatus according to the embodiment of the present disclosure.

Next, with reference to FIG. 4, a conveyance guide which forms predetermined portions of the relay conveyance path will be described. FIG. 4 is a side view showing the conveyance guide 81. A plurality of the conveyance guide 81 is disposed along the relay conveyance path at predetermined intervals.

The conveyance guide 81 includes a fixed guide 83 and a movable guide 85 movable with respect to the fixed guide 83. For example, the movable guide 85 is turnable around its rear end portion, and turned between a path formation position (refer to the solid line in FIG. 4) where the it is turned so as to form the relay conveyance path and a path opening position (refer to the thin two-dotted line in FIG. 4) where it is turned so as to open the relay conveyance path. By turning the movable guide 85 to the path opening position, it becomes possible to remove the sheet remaining on the relay conveyance path. The movable guide 85 has a lever 87 operated by an operator, and the operator holds the lever 87 and then turns the movable guide 85.

Figure 5:
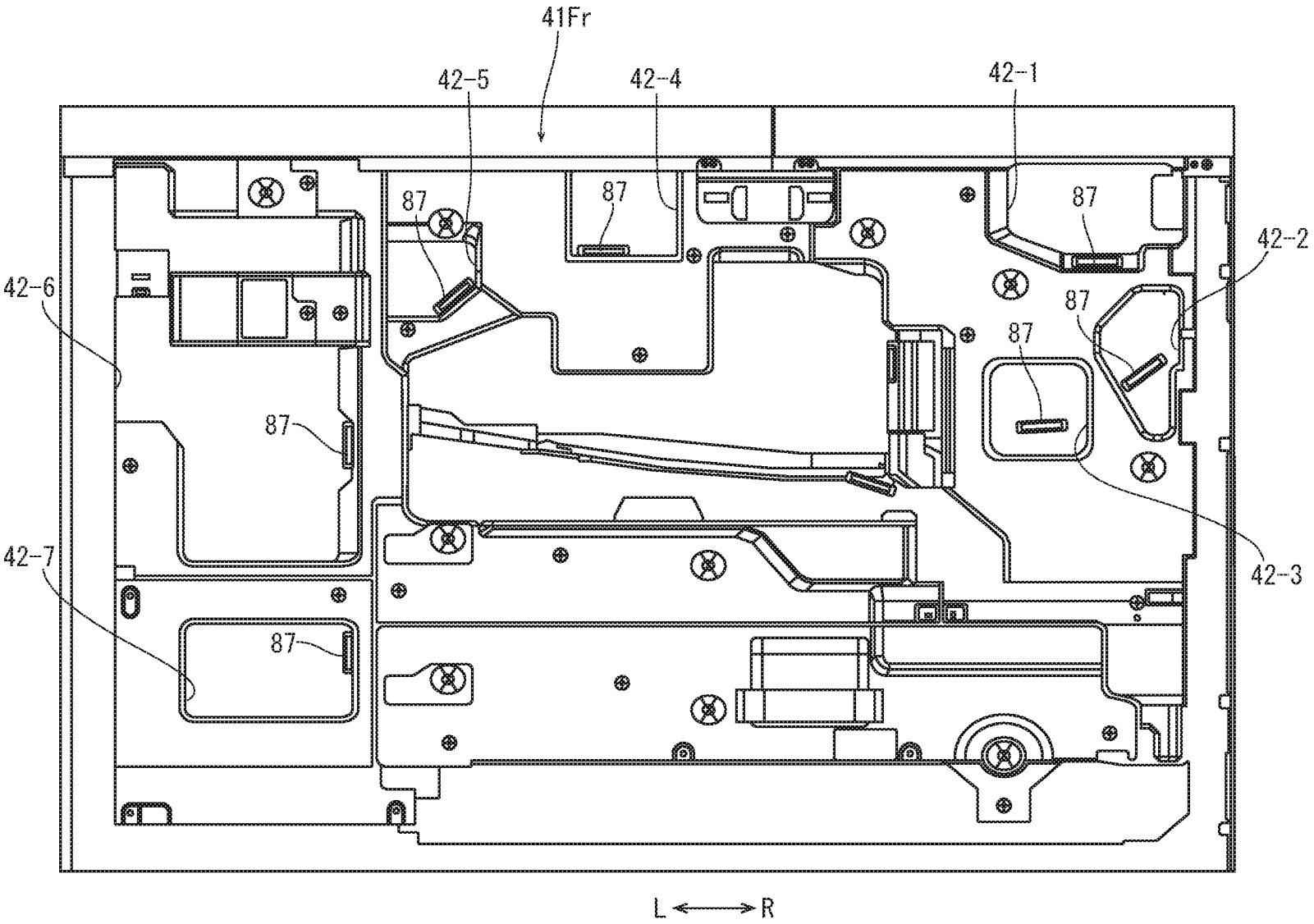
FIG. 5 is a front view showing a front side plate of a casing in the relay conveyance apparatus according to the embodiment of the present disclosure.

Next, with reference to FIG. 5, the front side plate 41Fr of the casing 41 will be described. FIG. 5 is a front view showing the front side plate 41Fr. The front side plate 41Fr of the casing 41 has openings 42-1 to 42-7 (hereinafter, called the opening 42 simply) at corresponding portions to the above predetermined portions of the relay conveyance path. The predetermined portions contain the carrying-in path M1, the switch-back path I11 of the first inversion path I1, the returning path I13 of the first inversion path I1, the switch-back path I21 of the second inversion path I2, the lower sub path S22, the second correction path C2 and the discharge path M3, for example. The lever 87 of the movable guide 85 is turned through the openings 42. The predetermined portion is not limited the above portions.

Figure 6:
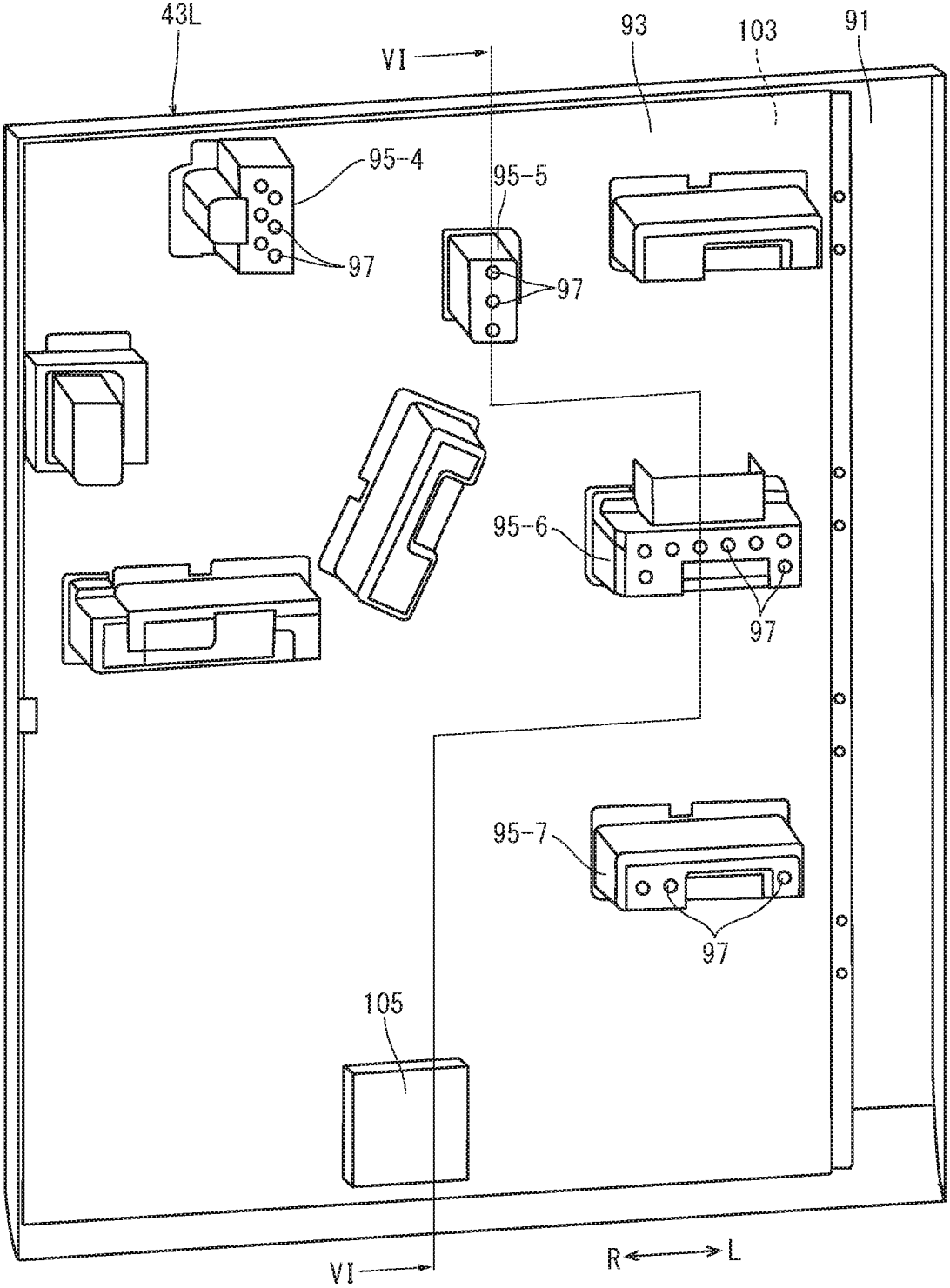
FIG. 6 is a perspective view showing an inner surface of a left cover plate in the relay conveyance apparatus according to the embodiment of the present disclosure.
Figure 7:
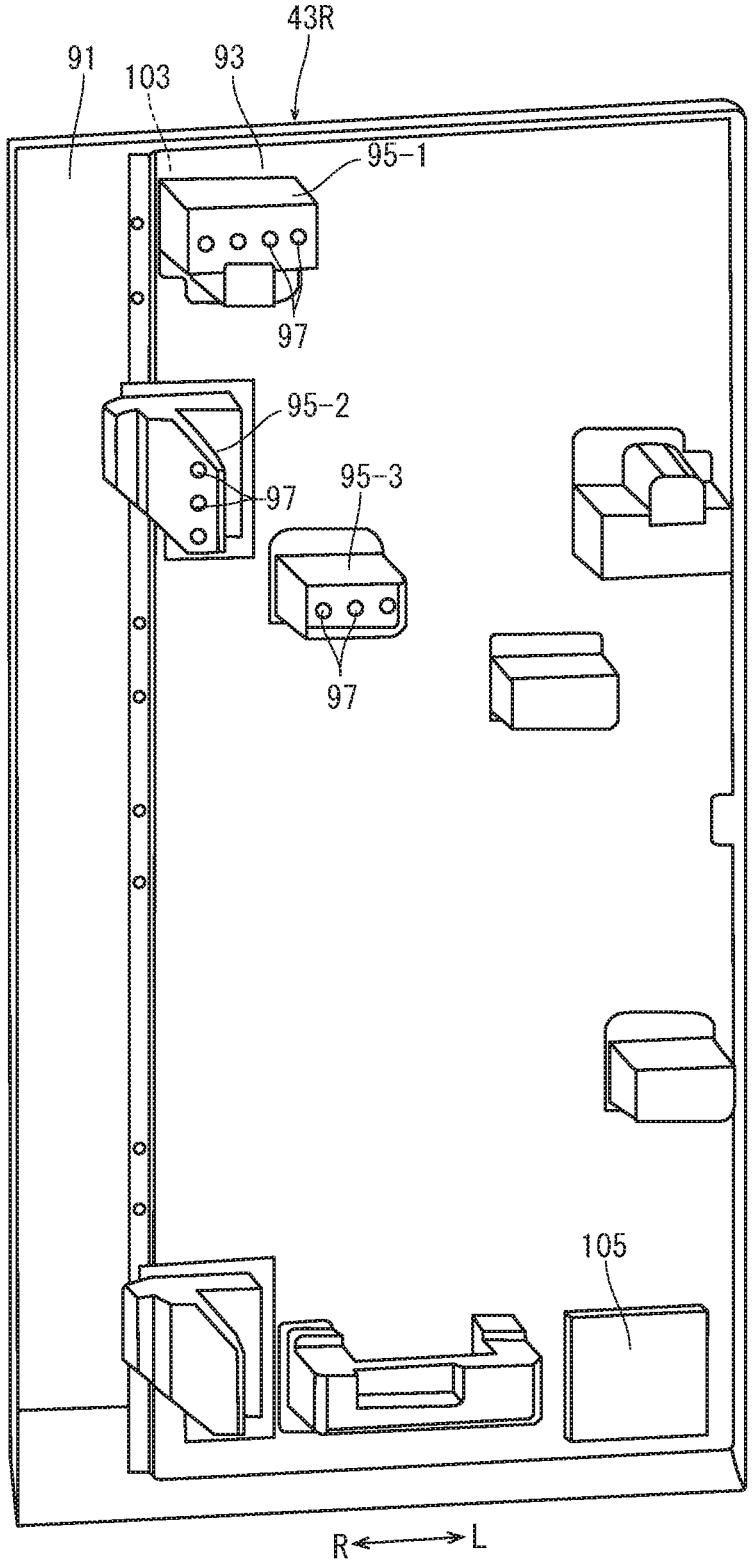
FIG. 7 is a perspective view showing an inner surface of a right cover plate according to the embodiment of the present disclosure.

Next, the left cover 43L and the right cover 43R will be described with reference to FIG. 6 and FIG. 7. FIG. 6 is a perspective view showing the left cover and FIG. 7 is a perspective view showing the right cover.

Each of the left and right covers 43L and 43*r* has an outer plate 91 and an inner plate 93 fixed to the inner surface of the outer plate 91 via a predetermined gap. Between the outer plate 91 and the inner plate 93, a closed space is formed. The left cover 43L is larger than the right cover 43R. The left cover 43L is supported by the front side plate 41Fr of the casing in a turnable manner around its left end portion. The right cover 43R is supported by the front side plate 41Fr of the casing 41 in a turnable manner around its right end portion. By opening the left and right covers 43L and 43R, the front side plate 41Fr of the casing 41 (refer to FIG. 5) is exposed.

On the inner plate 93 of each of the left and right covers 43L and 43R, protruding parts 95-1 to 95-7 (hereinafter, called the protruding part 95 simply) are formed at corresponding portions to the above predetermined portions. The protruding parts 95-1 to 95-7 have sizes insertable into the corresponding openings 42-1 to 42-7 of the front side plate 41Fr, and have shapes and heights (the protruding height from the inner plate 93) corresponding to the above predetermined portions of the relay conveyance path. The protruding part 95 has a hollow portion 96 communicating with the closed space between the inner plate 93 and the outer plate 91. On the tip end surface and the side surfaces of the protruding part 95, air blowing ports are formed. The protruding part 95 may be formed integrally with the inner plate 93 or may be formed separately from the inner plate 93 and fixed to the inner plate 93 using screws.

A function of the protruding part 95 will be described. In a state where the movable guide 85 of the conveyance guide 81 is turned to the path formation position (refer to the solid line in FIG. 4), when the left and right cover 43L and 43R are closed, the protruding parts 95-1 to 95-7 are inserted into the inner space (the space above the relay conveyance path) of the casing 41 through the openings 42-1 to 42-7 of the front side plate 41Fr. In other words, the protruding parts 95-1 to 95-7 are inserted into the inner space of the casing 41, so that it becomes possible to close the left and right covers 43L and 43R. On the other hand, in a state where the movable guide 85 of the conveyance guide 81 is turned to the path opening position (refer to the thin two-dotted line in FIG. 4), when the left and right covers 43L and 43R are closed, the protruding part 95 interferes with the movable guide 85 or the lever 87 so as not to insert into the inner space of the casing (the space above the relay conveyance path). In other words, because the protruding part 95 cannot be inserted into the inner space of the casing 41, it becomes impossible to close the left and right covers 43L and 43R.

In the above described manner, the protruding part 95 restricts the closing of the front cover 43 in a state where the movable guide 85 is turned to the path opening position, and therefore restricts the performing of the conveyance operation in a state where the relay conveyance path is not formed.

Figure 8:
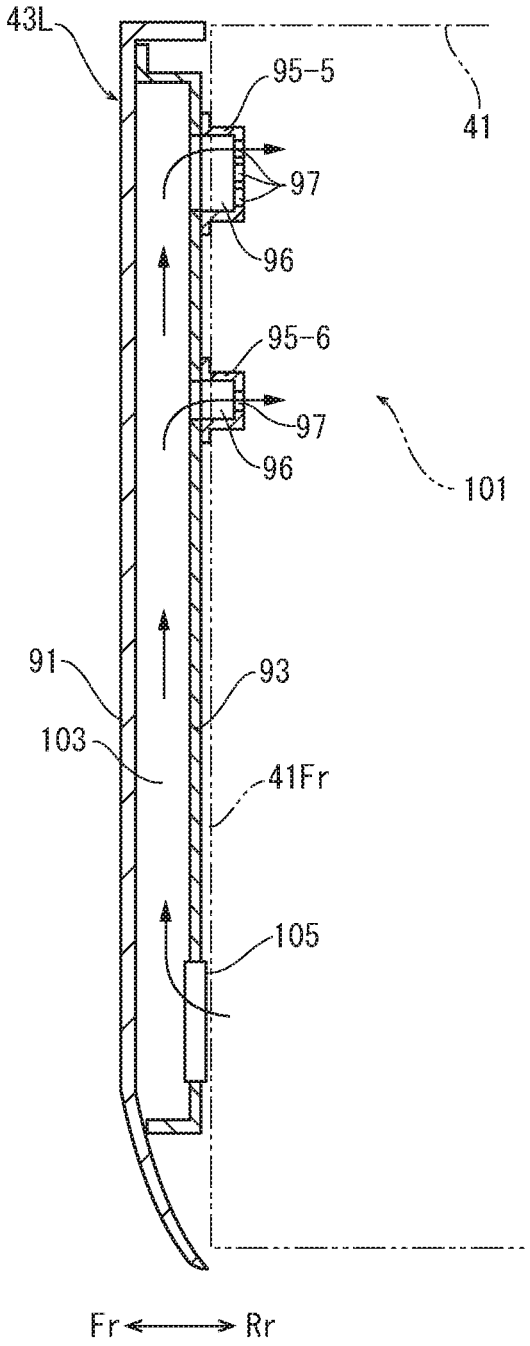
FIG. 8 is a sectional view (a sectional view taken along the line VI-VI in FIG. 6) schematically showing a cooling mechanism in the relay conveyance apparatus according to the embodiment of the present disclosure.
Figure 9:
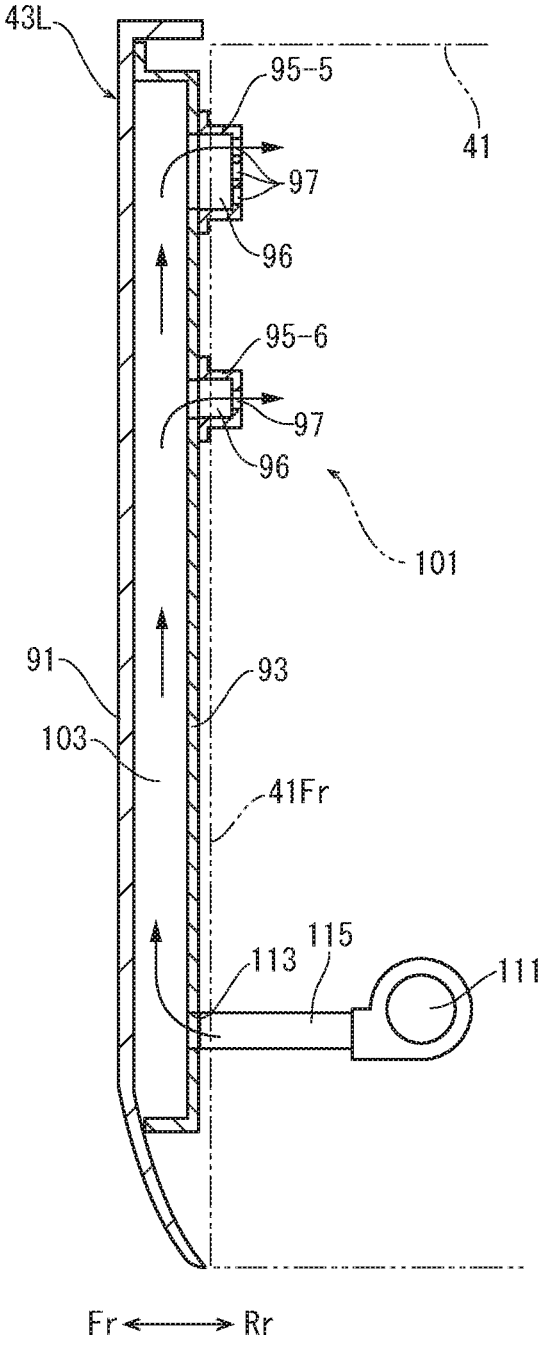
FIG. 9 is a sectional view schematically showing a modified example of the cooling mechanism in the relay conveyance apparatus according to the embodiment of the present disclosure.

The relay conveyance apparatus 1 includes a cooling mechanism 101 which cools the above predetermined portions of the relay conveyance path. The cooling mechanism 101 will be described with reference to FIG. 8. FIG. 8 is a sectional view showing the cooling mechanism (a sectional view taken along the line VI-VI in FIG. 6).

The cooling mechanism 101 includes a main duct 103 formed in the left and right cover 43L and 43R, an air blowing port 97 formed in the protruding part 95 and a fan 105 attached to the lower end portion of each inner plate 93.

The main duct 103 is formed in the closed space between the outer plate 91 and the inner plate 93 of the left and right covers 43L and 43R. The fan 105 is a propeller fan, for example, and takes outside air in the main duct 103. When each fan 105 is driven and the outside air is taken in the main duct 103 in a state where the front cover 43 is closed, the taken outside air (the cooling air) rises through the main duct 103, and is blown out to the relay conveyance path from the protruding part 95 through the air blowing ports 97. The main duct 103 may be formed in the whole space of the closed space between the outer plate 91 and the inner plate 93 or may be formed so as to branch from the fan 105 to each protruding part 95.

A sheet conveyance operation of the relay conveyance apparatus 1 having the above configuration will be described with reference to FIG. 3. When the first sheet is carried in the carrying-in path M1 through the carrying-in port 51, the first warm air sending unit 71-1 sends warm air to the carrying-in path M1. The warm air is blown on the first sheet carried in the carrying-in path M1 to correct the curl of the first sheet and to dry the first sheet.

The first sheet is conveyed from the carrying-in path M1 to the first inversion path I1 at the first branch point D1. The first sheet is conveyed from the going path I12 to the switch-back path I11 in the conveyance direction V while decreasing the conveyance speed. When the first sheet is conveyed to the switch-back path I11, the first sheet is temporarily stopped, and thereafter, the first sheet is conveyed from the switch-back path I11 to the returning path I13 in the re-conveyance direction Vr while increasing the conveyance speed. Thereby, the front and back of the first sheet is inversed. The front and back inversed first sheet is conveyed to the returning path I13, and then from the first inversion path I1 to the middle path M2 at the first join point J1.

After the first sheet is carried in through the carrying-in port 51, the second sheet is carried in the carrying-in path M1 through the carrying-in port 51 at a suitable timing. The first warm air sending unit 71-1 sends warm air to the second sheet so as to correct the curl of the second sheet and to dry the second sheet.

The second sheet is conveyed from the carrying-in path M1 to the second inversion path I2 at the first branch point D1. The second sheet is conveyed from the going path I22 to the switch-back path I21 in the conveyance direction V while decreasing the conveyance speed. When the second sheet is conveyed to the switch-back path I21, the second sheet is temporarily stopped, and thereafter, the second sheet is conveyed from the switch-back path I21 to the returning path I23 in the re-conveyance direction Vr while increasing the conveyance speed. Thereby, the front and back of the second sheet is inversed. The front and back inversed second sheet is conveyed to the returning path I23, and then from the second inversion path I2 to the middle path M2 at the first join point J1.

While the first sheet is switched back on the switch-back path I11 and the second sheet is switched back on the switch-back path I21, the second and third warm air sending units 71-2 and 71-3 send warm air at the same time to correct the curl the first and second sheets and to dry the first and second sheets.

The first sheet conveyed to the first inversion path I1 and the second sheet conveyed to the second inversion path I2 are switched back at the same timing, and then conveyed to the middle path M2 successively at a predetermined time interval. While the first and second sheets are conveyed along the middle path M2, the fourth air sending unit 71-4 sends warm air to the sheets.

The first sheet is conveyed from the middle path M2 to the first correction path C1 at the second branch point D2. In the first correction path C1, the pairs of switching rollers 61 and the pair of correction rollers 63 are rotated to convey the first sheet to a predetermined position in the conveyance direction V. After a sheet position detection sensor (not shown) detects a position of the first sheet in the width direction, the rotation of the pairs of switching rollers 61 and the pair of correction rollers 63 is temporarily stopped while the first sheet nipped. Next, the upper roller 61*a* of each pair of switching rollers 61 is moved from the nip position (refer to the solid line in FIG. 3) to the nip release position (refer to the dotted line in FIG. 4). Thereafter, the pair of correction rollers 63 is moved in the width direction while the first sheet nipped, based on the detection result of the above sheet position detection sensor. That is, the conveyance of the first sheet is temporarily stopped. For example, in a case where the above sheet position detection sensor detects that the first sheet is displaced by 1 mm to one side (the front side) from the reference position in the width direction, the pair of correction rollers 63 is moved by 1 mm to the other side (the rear side) in the width direction. This makes it possible to correct the position of the first sheet in the with direction.

After a position of the first sheet is corrected in the width direction, the upper roller 61*a* of each pair of switching rollers 61 is moved from the nip release position (refer to the dotted line in FIG. 3) to the nip position (refer to the solid line in FIG. 3). Thereafter, the rotation of the pairs of switching rollers 61 and the pair of correction rollers 63 is started, and the position corrected first sheet is conveyed from the first correction path C1 to the discharge path M3 at the second join point J2 in the re-conveyance direction Vr.

The second sheet is conveyed along the middle path M2, and then from the middle path M2 to the second correction path C2 at the second branch point D2. On the second correction path C2, a position of the second sheet is corrected in the width direction in the same manner as the first correction path C1. Thereafter, the rotation of the pairs of switching rollers 61 and the pair of correction rollers 63 is started, and the position-corrected second sheet is conveyed from the second correction path C2 to the discharge path M3 at the second join point J2 in the re-conveyance direction Vr.

On the first correction path C1 and the second correction path C2, the fifth and sixth warm air sending units 71-5 and 71-6 send warm air to correct the curl of the first and second sheets and to dry the first and second sheets. Thereafter, the positions of the first sheet conveyed to the first correction path C1 and the second sheet conveyed to the second correction path C2 are corrected at the same timing, and then conveyed to the discharge path M3 successively at a predetermined time interval.

The first sheet is conveyed from the discharge path M3 to the upper discharge path M32 at the fourth branch point D4, discharged through the upper deliver port 53 and then carried in the carrying-in port 31 of the post-processing apparatus 5. In the same manner, the second sheet is conveyed from the discharge path M3 to the upper discharge path M32 at the fourth branch point D4, discharged through the upper deliver port 53 and then carried in the carrying-in port 31 of the post-processing apparatus 5. When the first and second sheets are conveyed along the discharge path M3, the seventh warm air sending unit 71-7 sends warm air to the sheets. In a case where the stacker but not the post-processing apparatus 5 is coupled with the relay conveyance apparatus 1, the sheet is conveyed along the discharge path M3 to the lower discharge path M31 at the third branch point D3, and then carried in the stacker through the lower deliver port 55.

The sheet not requiring the inversion processing, the correction processing and the post-processing is conveyed from the carrying-in path M1 to the going path I22 of the second inversion path I2 at the first branch point D1, conveyed from the returning path I22 to the first sub path S1 at the fifth branch point D5, and then conveyed along the first sub path S1. Thereafter, the sheet is discharged from the first sub path S1, and then stacked on the discharge tray 57. The sheet not requiring the inversion processing and the correction processing and requiring the post-processing is conveyed from the carrying-in path M1 to the returning path I22 of the second inversion path I2 at the first branch point D1, conveyed along the switch-back path I21, conveyed from the switch-back path I21 to the upper sub path S21 at the seventh branch point D7, and then conveyed to the upper discharge path M32 at the fourth join point J4.

If a sheet jamming occurs during the above conveyance of the sheet, the conveyance is stopped and the cooling mechanism 105 is driven. That is, the fans 105 attached to the left and right covers 43L and 43R are driven. Then, as shown by the arrow in FIG. 8, outside air (cooling air) is taken in the main duct 103, risen in the main duct 103, and then blown out through the air blowing ports 97 of the protruding parts 95 to the relay conveyance path. The relay conveyance path which is heated by the warm air sending units 71 is cooled by the blowing air.

When the operator opens the front cover 43 in order to remove the jammed sheet, the cooling mechanism 101 is stopped. That is, the fans 105 are stopped. Because the front side plate 41Fr is exposed when the front cover 43 is opened, the operator operates the lever 87 of the movable guide 85 through the opening 42 disposed near the position where the sheet jamming occurs, turns the movable guide 85 to the path opening position to open the relay conveyance path, and then removes the jammed sheet.

After removing the jammed sheet, the operator operates the lever 87 to turn the movable guide 85 to the path formation position, and then closes the front cover 43.

As described above, according to the relay conveyance apparatus 1 of the present disclosure, the relay conveyance path is cooled by the cooling mechanism 101 during the treatment of the sheet jamming, so that it becomes possible to decrease uncomfortable feel applied to the operator.

The cooling operation of the cooling mechanism 101 is performed only during a time period from when the sheet jamming occurs in the relay conveyance path and the conveyance of the sheet is stopped to when the front cover 43 is opened. As described above, the relay conveyance path is preferably heated in order to promote the drying of the sheet. Then, by decreasing the cooling time as much as possible, the relay conveyance path is not cooled excessively so that it becomes possible to restart the conveyance of the sheet after a short time of period. Furthermore, the conveyance guide 81 which allows the relay conveyance path to open is disposed to the predetermined portion (for example, a portion where the sheet jamming easily occurs particularly) on the relay conveyance path, so that a number of the opening 42 formed in the front side plate 41Fr is decreased to keep a temperature of the relay conveyance path at a suitable temperature.

Additionally, the fan 105 is attached to the lower end portion of the front cover 43, so that it becomes possible to take a relatively low temperature outside air in the main duct 103. Furthermore, it becomes possible to make a whole structure of the relay conveyance apparatus 1 simple. Furthermore, the main duct 103 is made to be short in length relatively, so that a loss in flow amount can be decreased. By using the protruding part 95, a number of added members can be decreased. The fan 105 may be attached to the outer plate 91.

Next, with reference to FIG. 8, a modified example of the cooling mechanism 101 will be described. FIG. 8 is a sectional view showing the cooling mechanism.

The cooling mechanism 101 of the modified example includes a fan 111 attached to the casing 41, a vent hole 113 formed in the inner plates 93 of the left and right covers 43L and 43L and a sub duct 115 formed between the fan 111 and the vent holes 113.

The fan 111 is a sirocco fan, for example, and attached to the lower end portion of the inner space of the casing 41. The vent holes 113 are formed in the lower end portion of the inner plates 93, and communicated with the main duct 103. The sub duct 115 is branched from the fan 111 to the vent holes 113 of the inner plate 93 of the left cover 43L and the bent holes 113 of the inner plate 93 of the right cover 43R. When the left and right covers 43L and 43R are closed, the sub duct 115 is communicated with the vent holes 113.

In the modified example, when the sheet jamming occurs on the relay conveyance path, the cooling mechanism 101 is driven. That is, outside air is taken in the sub duct 115 by the fan 111. The taken outside air enters the main duct 103 from the sub duct 115 through the vent holes 113, is risen in the main duct 103, and sent in the relay conveyance path through the air blowing ports 97 of the protruding part 95. This cools the relay conveyance path.

In the modified example, because the fan 111 is attached to the casing 41, it becomes possible to make the left and right covers 43L and 43R light. Furthermore, it is not required to wire an electric wire and a signal wire connected to the fan 111 on the front cover 43, so that it becomes possible to make the wiring work simple.

Although the present disclosure is described with respect to specific embodiments, the disclosure is not limited to the above described embodiment. Those skilled in the art can modify the above embodiment without departing from the scope and sprit of the present disclosure.

The invention claimed is:

1. A relay conveyance apparatus disposed between an image forming apparatus forming an image on a sheet and a post-processing apparatus performing a post-processing on the sheet, the relay conveyance apparatus comprising:

a casing having an inner space;

a relay conveyance path formed in the inner space, along which the sheet is conveyed from the image forming apparatus to the post-processing apparatus;

an opening formed in a side plate of the casing, and through which the inner space of the casing is exposed;

a cover which opens and closes the opening;

a conveyance guide switchable between a path formation position where the relay conveyance path is formed and a path opening position where the relay conveyance path is opened;

a protruding part provided in the cover such that when the conveyance guide is switched to the path formation position, the protruding part is inserted into the inner space of the casing to allow closing of the cover, and when the conveyance guide is switched to the path opening position, the protruding part interferes with the conveyance guide to inhibit from being inserted into the inner space of the casing and to restrict the closing of the cover; and a cooling mechanism which cools the relay conveyance path, wherein the cooling mechanism includes:

a main duct provided in the cover and through which cooling air is passed;

a fan which feeds the cooling air to the main duct; and an air blowing port provided in the protruding part, and through which the cooling air is blown from the main duct to the relay conveyance path.

2. The relay conveyance apparatus according to claim 1, wherein the cooling mechanism is operated until the cover is opened after a sheet jamming occurs in the relay conveyance path.

3. The relay conveyance apparatus according to claim 1, wherein the conveyance guide is disposed at a predetermined portion on the relay conveyance path, and operated through the opening in a state where the cover is opened.

4. The relay conveyance apparatus according to claim 3, wherein the protruding part is inserted into the inner space of the casing through the opening when the cover is closed in a state where the conveyance guide is switched to the path formation position.

5. The relay conveyance apparatus according to claim 1, wherein the fan is attached to a lower end portion of the cover.

6. The relay conveyance apparatus according to claim 1, wherein the fan is attached to a lower end portion of the casing, and the cooling mechanism includes a sub duct connecting the fan to the main duct.

7. The relay conveyance apparatus according to claim 1, wherein the cover includes an outer plate and an inner plate, the main duct is formed between the outer plate and the inner plate, and the protruding part is formed in the inner plate and has a hollow portion which is communicated with the main duct.

8. An image forming system comprising:

an image forming apparatus forming an image on a sheet;

a post-processing apparatus performing a post-processing on the sheet; and the relay conveyance apparatus according to claim 1, disposed between the image forming apparatus and the post-processing apparatus.

* * * * *